United States Patent [19]

Cheshire et al.

[11] Patent Number: 4,764,253

[45] Date of Patent: Aug. 16, 1988

[54] METHOD FOR CONTROLLING FEED OF FOAMED FIBER SLURRIES

[75] Inventors: James O. Cheshire; Bruce W. Janda, both of Neenah; Robert S. Thut, Green Bay, all of Wis.

[73] Assignee: James River-Norwalk, Inc., Norwalk, Conn.

[21] Appl. No.: 816,339

[22] Filed: Jan. 6, 1986

[51] Int. Cl.[4] ..... D21C 1/06

[52] U.S. Cl. ..... 162/198; 162/212; 162/259

[58] Field of Search ..... 162/263, 343, 347, 253, 162/258, 259, 262, 198, 183, 212, 213, DIG. 11

[56] References Cited

U.S. PATENT DOCUMENTS

| | | | |
|---|---|---|---|
| 3,650,891 | 3/1972 | Dahlin | 162/263 |
| 3,716,449 | 2/1973 | Gatward et al. | 162/183 |
| 4,384,922 | 5/1983 | Stotz | 162/259 |
| 4,526,653 | 7/1985 | Andersson | 162/259 |

FOREIGN PATENT DOCUMENTS

| | | | |
|---|---|---|---|
| 0607867 | 5/1978 | U.S.S.R. | 162/258 |

OTHER PUBLICATIONS

Hubbe, "Digester Problem Statement"; *Tappi*, vol. 49, No. 5, May 1966, pp. 61A–69A.

*Primary Examiner*—Steve Alvo
*Attorney, Agent, or Firm*—Cooper & Dunham

[57] ABSTRACT

In a papermaking or like operation wherein fibers are supplied to a headbox in a foamed furnish, a method of controlling furnish flow including the steps of controllably advancing the furnish along a flow path to the headbox, measuring the volume flow rate of furnish through a fixed cross-sectional area in the path with a magnetic flowmeter, combining the flow rate measurement at least with measured values of furnish density and pressure in the path and with a reference pressure value to obtain a corrected volume flow rate value, and controlling the advance of furnish in the path upon departure of this corrected value from a desired value so as to change the corrected value toward the desired value. A temperature measurement can also be combined with the other measured values, and with a reference temperature value, in obtaining the corrected flow rate value. If the headbox has a variable slice opening, a measured value of slice opening dimension can be combined with the corrected volume flow rate value to ascertain the discharge velocity of the furnish issuing from the headbox, and the control of furnish advance can be made responsive to departure of this ascertained velocity from a desired value so as to charge the ascertained velocity toward the desired value. The method can be practiced to control plural furnish flows supplied to a multichannel headbox, with the corrected flow rate values of the individual flows being summed to obtain a total flow rate or ascertained velocity value for control of overall flow conditions. Apparatus for controlling a flow or flows of foamed furnish includes a magnetic flowmeter, devices for making and transmitting measurements of at least furnish density and pressure, a control unit for receiving and combining the measurements thus made by the flowmeter and the other devices, and furnish flow control means such as a variable speed pump controlled by signals from a control unit.

8 Claims, 1 Drawing Sheet

METHOD FOR CONTROLLING FEED OF FOAMED FIBER SLURRIES

BACKGROUND OF THE INVENTION

This invention relates to the manufacture of fibrous web articles such as paper. It is particularly directed to methods and apparatus for controlling feed of foamed fiber-containing slurry to a moving foraminous support on which the fibers are deposited to form a continuous web.

In a conventional papermaking operation, an aqueous slurry (furnish) of wood and/or other fibers is discharged through the outlet (slice opening) of a distributor (headbox) onto the surface of a continuously moving foraminous support (Fourdrinier wire), or between facing surfaces of two such moving supports, for deposit of the fibers thereon so as to constitute a continuous fibrous web, which is dried and commonly subjected to other subsequent treatments. Especially for the manufacture of products such as tissues, close control of the linear velocity of the slurry jet discharged through the slice opening is important, because the relationship between the jet velocity and the linear speed of the forming (Fourdrinier) wire determines the orientation of the fibers in the web, and this in turn governs such product properties as tensile ratio (longitudinal vs. transverse tensile strength) of the web.

Flow control is also important for operations in which a plurality of fiber-containing slurry flows are discharged through a multichannel or multislice headbox onto a moving foraminous support so as to produce a stratified web comprising (for instance) a bulk-providing central stratum sandwiched between thinner but tougher outer strata. Such operations are described, for example, in U.S. Pat. No. 4,086,130 (Justus). With a multichannel headbox, it is necessary to control the ratio of the flow rates in the respective headbox channels and the total flow rate through the headbox as well as to control the relationship between slurry jet velocity and speed of the forming wire.

When a simple liquid-fiber slurry is used, flow control in papermaking operations is reasonably straightforward. It is sometimes preferred, however, to employ as the slurry vehicle (in which the fibers are dispersed) a mixture of gas and liquid, such as a dispersion of air bubbles in water with a suitable surfactant, as described in U.S. Pat. No. 3,716,449 (Gatward et al.). For example, a foamed slurry is advantageous in some procedures for forming a bulky web of fibers that have been rendered anfractuous (kinked) by milling, because water tends to relax the desired kinked state of the fibers, and a foamed vehicle reduces the exposure of the fibers to water. Control of flow rate and headbox jet velocity of foamed slurries has heretofore presented substantial difficulties, since the variability of foamed (gas-liquid) slurry vehicles in respect of such fluid properties as density, viscosity, and compressibility prevents application thereto of conventional flow control techniques.

SUMMARY OF THE INVENTION

The present invention, in a first aspect, is concerned with improvements in procedure for continuously discharging a flow of foamed gas-liquid-fiber slurry through a headbox slice opening onto a continuously moving foraminous support to establish thereon a continuous web of fibers. Stated broadly, the invention in this aspect contemplates the provision of a method of controlling the flow of the slurry through the headbox, comprising the steps of controllably advancing a flow of the slurry along a defined path into the headbox for impelling the slurry through the slice opening onto the foraminous support, while sensing, and producing first, second, and third signals respectively representative of, the volume flow rate M of the slurry at a given point in the path, the density D of the slurry in the path, and the pressure P of the slurry in the path, and while combining these signals with each other and with values representative of a reference pressure $P_1$ and a temperature ratio $T_r$ to determine the value F of a flow condition of the slurry, in accordance with the relation $$F=MD+M(1-D)T_rP/P_1;$$

and controlling the advance of the slurry along the path, in response to departure of F from a desired value $F_o$, for changing the value of F toward $F_o$.

In this method, in accordance with the invention, the volume flow rate value M is ascertained with a magnetic flowmeter that detects flow velocity through a region of fixed cross-sectional area in the slurry path. Since the slurry is a foam, i.e. a gas-liquid-solid system, the measured value V is corrected for changes in density, pressure and temperature. These corrections are performed by measuring the foam density and considering the flow as two separate systems: a liquid-solid (fiber) system, considered as incompressible, and a volume of gas (or air fraction) affected by pressure and temperature as predicted by Boyle's and Charles' laws of gas volume behavior. Under circumstances in which isothermal conditions can be assumed, the value of $T_r$ is unity; where significant temperature change may be present, $T_r$ is determined by sensing, and producing a signal representative of, the absolute temperature t of the slurry in the path, and combining that signal with a reference temperature value $T_1$ in accordance with the relation $T_r=T_1/T$.

As a particular feature of the invention, the present method may be employed to control the linear velocity V of the slurry flow or jet discharge through the headbox slice opening. Thus, with a conventional, generally rectangular headbox slice opening having a fixed width W and a variable height H, the method of the invention as employed for jet velocity control further includes the step of sensing, and producing an additional signal representative of, the slice opening height H; the combining step further comprises combining the determined value of F with the additional signal and with a value representative of the slice opening width W to determine the value V of the velocity of the slurry as discharged through the slice opening, in accordance with the relation $V=F/WH$; and the controlling step comprises controlling the advance of the slurry flow along the path in response to departure of V from a desired value $V_o$, for changing the value of F toward a value of $F_o$ such that $F_o=V_oWH$. The value $V_o$ may be a predetermined value or may, for example, be a value derived by monitoring the linear velocity S of the foraminous support and determining the slurry discharge velocity $V_o$ necessary to maintain a desired relationship $r_o$ between the slurry jet velocity and S, i.e. such that $V_o=r_oV_s$. In this case, of course, the desired value $F_o$, toward which F is changed, may not be separately ascertained but is inherent in performance of the controlling step to achieve a desired $V_o$, since the performance of the controlling step to approach a desired $V_o$ involves changing F toward that value (i.e., $F_o$) which will provide the desired $V_o$.

In one important specific sense, the method of the invention is particularly applicable to procedures wherein plural flows of foamed gas-liquid-fiber slurry are discharged in substantially parallel contiguous relation to each other through a multichannel headbox slice opening onto a continuously moving foraminous support to establish thereon a continuous web of the fibers having plural strata respectively corresponding to the plural flows. As embodied in such procedures, the present method contemplates controllably advancing the plural slurry flows along respective defined paths into the headbox; for each of the plural flows, performing the steps of sensing, and producing signals representative of, M, D, and P as defined above; and, again for each flow, combining the aforementioned signals with each other and with values representative of $P_1$ and $T_r$ to determine a value F for each of the plural flows.

The method of the invention can, for example, be employed to control plural flows so as to maintain a desired ratio R between their respective F values, i.e., $R=F(a)/F(b)$, where F(a) and F(b) are the respective F values of the two flows. In another instance of the use of the present method for control of plural flows, the combining step may further comprise adding together the values of F determined for the individual flows to obtain a total value F(TOT), and the control step may comprise controlling the advance of at least one of the plural flows along its respective path in response to departure of F(TOT) from a desired value $F_o$(TOT), for changing the value of F(TOT) toward $F_o$(TOT). As applied to the control of combined slurry jet velocity where plural flows are discharged from a multichannel headbox having a generally rectangular slice opening of fixed width W and variable overall height H, the method may include the step of sensing, and producing an additional signal representative of, the slice opening height H; the combining step may further comprise combining the value of F(TOT) with the additional signal and with a value representative of W to determine the value V(TOT) of the velocity of the combined slurry flows as discharged through the slurry opening, in accordance with the relation $V(TOT)=F(TOT)/WH$; and the controlling step may comprise controlling the advance of at least one of the slurry flows along its respective path, in response to departure of V(TOT) from a desired value $V_o$(TOT), for changing the value of V(TOT) toward $V_o$(TOT).

In specific embodiments of the method as described above, for control of one or more slurry flows, the advancing step comprises operating a pump, having an output characteristic that is variable in response to a control signal, for advancing the slurry flow as aforesaid; and the controlling step comprises generating, and transmitting to the pump, a control signal in response to departure of F from a desired value $F_o$ as aforesaid. In the case of plural flows, to provide individual flow control or control of their relative F values, a separate pump may be used for each flow.

In a further aspect, the invention contemplates the provision of flow control apparatus in a system for producing a fibrous web article, viz. a system comprising a continuously movable foraminous support, headbox means having a slice opening for discharging onto the support a continuous flow of a foamed gas-liquid-fiber slurry to establish a continuous web of fibers thereon, means for defining a path of advance of the slurry to the headbox, and means for controllably impelling the slurry along the path. The apparatus of the invention broadly comprises a magnetic flowmeter for sensing, and producing a first signal representative of, the volume flow rate of the slurry flow through a fixed cross-sectional area in the path; means for sensing, and producing a second signal representative of, the density of the slurry in the path; means for sensing, and producing a third signal representative of, the pressure of the slurry in the path; and means for receiving the first, second and third signals and for combining them with each other and with at least one additional supplied value to determine a flow condition of the slurry in the path, the receiving means producing an output control signal, in response to departure of the determined flow condition from a desired value, for controlling the impelling means so as to change the flow condition toward the desired value.

To effect control of slurry jet velocity, in a system wherein the headbox has a generally rectangular slice opening of predetermined width and variable height, the apparatus of the invention further includes means for sensing, and producing a fourth signal representative of, the height of the slice opening; the receiving means receives the fourth signal; the additional supplied values comprise the fourth signal and values respectively representative of a reference pressure and of the width of the slice opening; and the determined flow condition is the velocity of the slurry flow as discharged from the slice opening. When isothermal conditions are not assumed, the apparatus also includes means for sensing, and producing an additional signal represenative of, the temperature of the slurry in the path; the receiving means receives the additional signal; and the additional supplied values include the additional signal and a value representative of a reference temperature.

In embodiments for use in a system in which plural generally parallel flows of gas-liquid-fiber slurry are continuously discharged through the slice opening, to establish on the moving support a stratified web of fibers, and in which the path-defining means defines a separate path for each slurry flow, the apparatus of the invention includes a separate magnetic flowmeter and density-sensing and pressure-sensing means as aforesaid for each flow; and the receiving means receives signals produced by each of the flowmeters and density-sensing and pressure-sensing means.

Further features and advantages of the invention will be apparent from the detailed description set forth below, together with the accompanying drawing.

DETAILED DESCRIPTION

Figure 1:
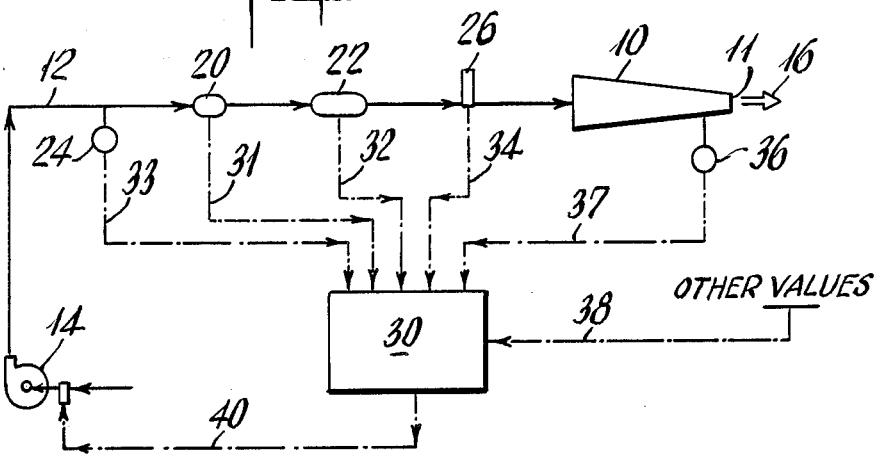
FIG. 1 is a highly simplified diagrammatic view of an embodiment of the apparatus of the invention arranged for control of a single flow of foamed slurry.

Referring first to FIG. 1, the system there represented is arranged to produce a single-ply paper web by wet forming on a continuously moving foraminous support, i.e. a Fourdrinier wire (not shown), or between a pair of such supports, to which a furnish (slurry of papermaking fibers) is delivered through a generally conventional single-slice headbox 10 having at its outlet end 11 a rectangular slice opening of fixed width and variable height. The furnish is advanced to the headbox along a line or flow path 12 by means of a pump 14 located upstream of the headbox, and is dispensed as a jet (arrow 16) from the headbox slice opening so as to impinge on the moving wire surface. Insofar, the system and its operation may be entirely conventional, incorporating provisions (not shown) for drying and subsequent treatment of the fibrous web formed on the wire or between the wires, all well-known to persons of ordinary skill in the papermaking art. It will be understood that the illustration of the system in FIG. 1 (as also in FIG. 2) is greatly simplified, many conventional elements and subsystems not material to the present invention having been omitted. Also, it will be understood that the present invention is equally applicable, in all its embodiments herein described, to single-wire and twin-wire forming systems; and that references herein to delivery of furnish onto a forming wire include delivery of furnish between a pair of forming wires.

To illustrate an important environment of use of the invention, the system of FIG. 1 will be described as provided with a foamed furnish such as, for example, a furnish prepared generally in accordance with the process disclosed in the aforementioned U.S. Pat. No. 3,716,449 (Gatward et al.), the disclosure of which is incorporated herein by this reference. In that process, papermaking fibers are uniformly dispersed in an aqueous solution of a foamable water-surfactant to produce a foamed liquid containing the fibers, i.e. a foamed furnish suitable to be dispensed onto a moving foraminous support to form a web. The slurry medium is a foamed dispersion comprising air, water, and surfactant, mixed with fibers e.g. to achieve a final consistency (as transported to the headbox) of about 0.3 to about 1.2% fibers by weight, and having (for example) an air content ranging between 55 and 75% by volume with a bubble size ranging between 20 and 200 microns in diameter. Suitable surfactants, and suitable subsystems and procedures for preparing, recycling and reconstituting the foamed medium, making up the furnish by mixing this medium with papermaking fibers, and diluting and deflaking the furnish, will be readily apparent to persons of ordinary skill in the art, and therefore need not be further described.

One exemplary instance of application of foamed furnishes is in the production of high-bulk paper webs constituted of mechanically kinked fibers which tend to relax (losing their ability to impart the desired bulk to the web) when exposed to water. Employment of a foamed medium with its relatively low volume content of water, in conjunction with control of agitation during fiber dispersal in the medium and limitation of overall dwell time of the fibers in the medium, minimizes the contact of the fibers with water and thereby aids in retention of their bulk-providing contortions. The foamed medium itself also tends to enhance the bulk of the produced web.

In at least many papermaking operations, as is well known, control of furnish flow rate is highly desirable or even essential. For example, particular mechanical properties (such as tensile ratio) in the web product are critically dependent on the relative linear velocities of the forming wire and of the furnish jet discharged through the headbox slice opening. The jet velocity may be simply expressed by the relation $$V=f/WH \quad (1)$$

wherein f is volume flow rate and WH is the area of the slice opening. With a liquid slurry medium, f can be ascertained by a simple direct measurement, but this is not possible with a foamed medium, owing to the variability of fluid properties of such media; yet continuous flow control is at least as important when a foamed furnish is used as when a liquid furnish is used. The features of the present invention, now to be described as incorporated in and practiced with the system of FIG. 1, overcome this difficulty so as to enable satisfactory continuous control of foamed furnish flows.

The apparatus of the invention, in the embodiment of FIG. 1, includes a magnetic flowmeter 20 that is selected to be sensitive at the very low standard conductivities (typically about 20 μmho/cm) measured for the process fluid (foamed furnish). This meter, mounted in line 12, measures the velocity of the fluid through its fixed cross-sectional area at a point in the flow path 12 between the pump 14 and the headbox 10, and produces and transmits an output signal representative of the volume flow rate through its fixed cross-sectional area. The meter presents no restriction in the flow path that would hinder passage of the solid (fiber) content of the furnish. Meters of this character, suitable for the described use, are commercially available and their structure and operation are well-known.

Further in accordance with the invention, means are provided for correcting the measurement of volume flow rate thus obtained for changes in density, pressure and temperature of the flow of foamed furnish. Thus, the apparatus of the invention in the embodiment of FIG. 1 also includes a density sensor/transmitter device 22 for measuring, and producing and transmitting an output signal representative of, the density of the flowing furnish at a locality in line 12 between the pump and the headbox; a pressure gauge/transmitter device 24 for measuring, and producing and transmitting an output signal representative of, the pressure of the furnish at a locality in line 12 between the pump and the headbox; and a temperature transmitter device 26 for measuring, and producing and transmitting an output signal representative of, the temperature of the furnish at a locality in line 12 between the pump and the headbox. The output signals produced by the flowmeter 20 and by each of the devices 22, 24, and 26 are transmitted (e.g. electrically) to a control unit 30, along suitable transmission lines respectively designated 31, 32, 33 and 34. Devices suitable for use as the elements 22, 24 and 26 are all commercially available.

In addition, a linear voltage differential transformer device 36 (likewise commercially available) is provided for measuring the variable height of the slice opening of the headbox 10, and producing and transmitting (again, e.g., electrically) a signal representative of that measurement along a line 37 to the control unit 30. Other values and/or measurements, including predetermined or preselected reference values of pressure and temperature and data defining a desired or target flow rate value, are also supplied to the control unit, the input of these values being indicated at 38.

The control unit receives the signals transmitted by flowmeter 20 and devices 22, 24 and 26 and combines them with each other and with other values from input 38 in accordance with the relation $$F=MD+M(1-D)T_1P/TP_1 \quad (2)$$

wherein

F = corrected volume flow rate of the foamed furnish;

M = volume flow rate measured by flowmeter 20;

D = specific gravity of the foamed furnish measured by device 22;

P = absolute pressure measured by device 24;

T = absolute temperature measured by device 26;

$P_1$ = reference pressure value from input 38; and $T_1$ = reference temperature value from input 38.

The control unit compares the value of F thus obtained with a desired value $F_o$, and generates and transmits (e.g. electrically, via line 40) a control signal to the pump 14 in response to any departure of F from $F_o$, for modifying the operation of the pump so as to change F toward $F_o$. Typically, the other values represented as introduced via input 38 also include the value W of the fixed width of the headbox slice opening, and the control unit 30 combines W with the measured value H of slice opening height received from device 36 and with F as obtained from relation (2) above, to determine the linear velocity V of the furnish jet at the slice opening, in accordance with the relation $$V=F/WH. \quad (3)$$

The control unit compares the value of V thus obtained with a desired value $V_o$, and in response to departure of V from $V_o$, generates and transmits the aforementioned control signal to the pump 14 for changing F toward a value of $F_o$ defined by the relation $$F_o=V_oWH. \quad (4)$$

The desired $V_o$ can be a predetermined value introduced to the control unit at input 38. Alternatively, the system can also include a device (not shown) for measuring, and transmitting to the control unit 30, the linear speed S of the forming wire; and input 38 can include a desired or predetermined value $r_o$ for the ratio of jet velocity V to wire speed S. The control unit 30 then derives $V_o$ from $r_o$ and S, in accordance with the relation $$V_o=r_oS. \quad (5)$$

As will be therefore be readily understood by persons of ordinary skill in the art, the control unit 30 may be any suitable and e.g. generally conventional data processing system capable of receiving the signals, performing the combinations and comparisons of values, and generating and transmitting the control signal, described above. The pump 14 is preferably a variable speed fan pump, such devices being again conventional. The signal from control unit 30 to pump 14 is such as to increase the speed of pump 14 if F falls below $F_o$, and to decrease the speed of pump 14 if F rises above $F_o$. It will be appreciated that in a broad sense, pump 14 is merely exemplary of elements or systems for controlling flow of furnish in line 12, and that other or additional flow-altering devices may be provided under control of unit 30 for changing the value of F.

The practice of the present method with the apparatus of FIG. 1 may now be readily explained. In steady-state papermaking operation, the forming wire is continuously advanced past the headbox 10, and foamed furnish, from a suitable supply system, is continuously advanced by pump 14 along line 12 and through the headbox 10, being impelled as a jet from the headbox slice opening onto the moving wire. While the furnish is being thus advanced, the flowmeter 20, and the devices 22, 24, and 26, continuously or repetitively sense the conditions obtaining in line 12 (viz. volume flow rate through the fixed meter cross-section, density, pressure, and temperature, respectively) and transmit signals, respectively representing the instantaneous measured values of these conditions, to the control unit 30 where the transmitted values are combined with each other and with reference values of pressure and temperature according to relation (2) above, to obtain, continuously or repetitively, instantaneous values of F. The control unit compares these values with a desired value $F_o$, and in response to departure of F from $F_o$, transmits a control signal to change the speed of the pump 14, in such manner as to change the value of F toward $F_o$.

The foregoing description of the operation of control unit 30 is to be understood as defining its overall functions in processing input signals and other values, and generating and transmitting output control signals in response thereto, but of course the processor of the control unit need not perform a formal calculation of, or a direct comparison of, F and $F_o$. For instance, where the headbox slice opening is of variable height, the differential transformer device 36 continuously or repetitively senses the instantaneous value of H and transmits a signal representing that instantaneous value to the control unit 30 for combination with the other signals or values to obtain an instantaneous value of headbox outlet jet velocity. Control signal generation occurs in response to departure of V from $V_o$, again as described above, to change the pump speed so as to alter the value of V toward the desired $V_o$, thereby inherently altering F toward the value $F_o$ defined by relation (4) above.

The transformer device 36 and its function are omitted in systems having a headbox slice opening of fixed dimensions. Also, in systems so operated that isothermal conditions can be assumed, the temperature sensing device 26 may be omitted and in such case, in relation (2) above, T is assumed to be equal to $T_1$; i.e., the temperature ratio $T_r=T_1/T=1$.

Figure 2:
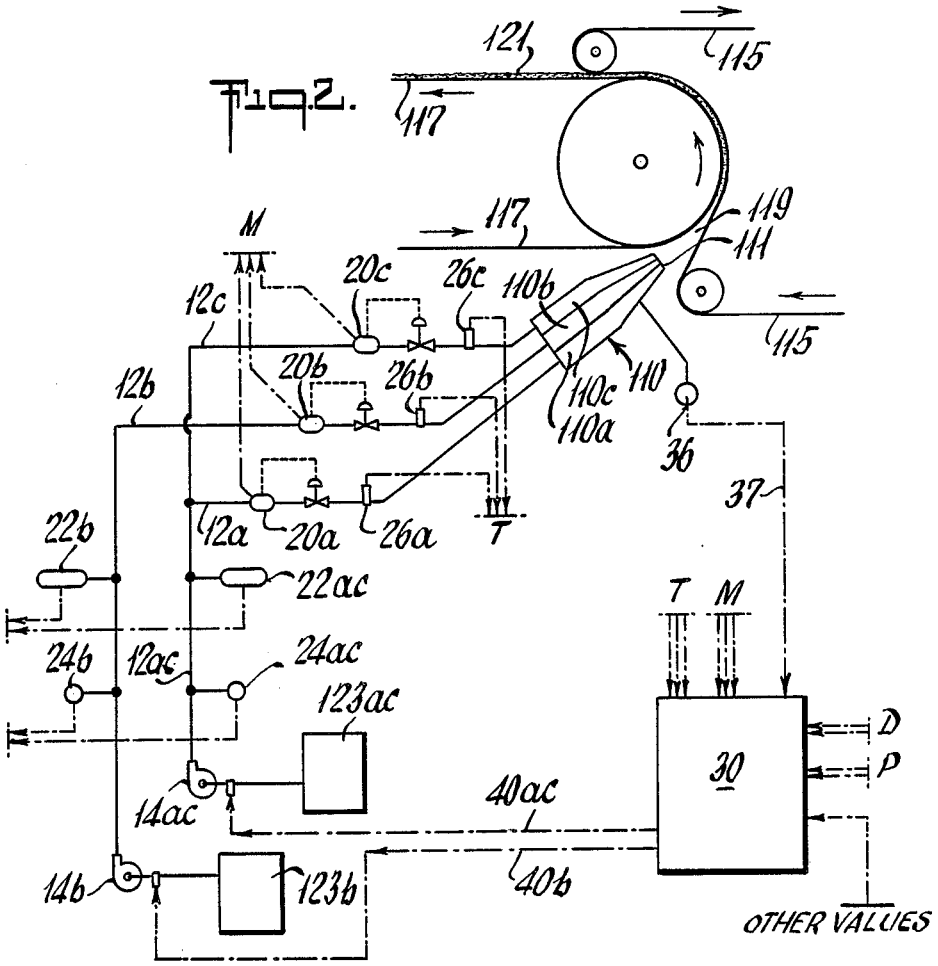
FIG. 2 is a similar view of a web-forming system having a multichannel headbox for delivering plural flows of foamed fiber-containing slurries between forming wires, and incorporating another embodiment of the flow-control apparatus of the invention.

FIG. 2 illustrates an embodiment of the invention arranged for controlling supply of plural flows of foamed furnishes to a multichannel or multislice headbox for producing, by wet forming between twin forming wires, a stratified single-ply paper web. The system of FIG. 2 includes a three-slice headbox having three channels respectively designated 110*a*, 110*b*, and 110*c* to which separate flows of foamed furnishes are delivered along lines or flow paths respectively designated 12*a*, 12*b* and 12*c*. An example of such a three-channel headbox is described in the aforementioned U.S. Pat. No. 4,086,130 (Justus), the disclosure of which is incorporated herein by this reference. The headbox disperses these furnishes in alternating layers on a forming wire or (as shown) between continuously moving forming wires 115 and 117 that converge to define a nip 119 immediately beyond the headbox; i.e. the three furnishes are discharged as a jet from a variable-height rectangular outlet or slice opening at end 111 of the headbox so as to enter the nip and to form, between the wires, a stratfied single-ply web 121 including a central stratum of fibers (from the furnish discharged through the central headbox channel 110*b*) sandwiched between outer strata of fibers (respectively from the furnishes discharged through outer headbox channels 110*a* and 110*c*). In the system shown, furnish is delivered to lines 12*a* and 12*c* (and thence to headbox channels 110*a* and 110*c*) from a common supply 123*ac* through a common line 12*ac;* thus, one flow of furnish is split and delivered to the two outer head box channels to form the two outer strata of the produced web. The furnish delivered to line 12*b* (for the central stratum of the web) is provided from a separate supply 123*b*, and may differ from the furnish of line 12*ac*, e.g. in fiber composition or fiber properties, so that the central stratum of the produced web is constituted of fibers of one type and the two outer strata are both constituted of fibers of a second type. In this system, both furnishes (i.e. the furnish from supply 123*ac* and the furnish from supply 123*b*) are foamed furnishes of the same general character as the foamed furnish described above with reference to FIG. 1.

The foamed furnish from supply 123*ac* is advanced along line 12*ac* and thence along lines 12*a* and 12*c* to the headbox channels 110*a* and 110*c* by means of a variable speed fan pump 14*ac* which may be generally similar to pump 14 of the system of FIG. 1. Similarly, the foamed furnish from supply 12*b* is advanced along line 12*b* to headbox channel 110*b* by means of a separate variable speed fan pump 14*b*. These pumps 14*ac* and 14*b* provide the force that impels the foamed furnish as a combined jet out of the slice opening of headbox 110 and into the nip 119.

The embodiment of the apparatus of the invention incorporated in the papermaking system of FIG. 2 comprises in elements generally corresponding to the elements of the embodiment of FIG. 1, except that flowmeters and devices for sensing density, pressure and temperature are provided for each of the furnish flows. Accordingly, elements of the FIG. 2 apparatus corresponding to elements of the FIG. 1 apparatus will be identified by like reference numerals, with letter suffixes, where appropriate, to indicate the particular furnish line with which they are associated.

Magnetic flowmeters 20*a*, 20*b* and 20*c* are respectively mounted in lines 12*a*, 12*b* and 12*c*, upstream of the headbox but downstream of the pumps 14*ac* and 14*b* and (in the case of meters 20*a* and 20*c*) also downstream of the point at which the line 20*ac* branches into separate lines 12*a* and 12*c*. Density sensor/transmitter devices 22*ac* and 22*b* are respectively provided in lines 12*ac* and 12*b*, between the pumps and the headbox, as are pressure gauge/transmitter devices 24*ac* and 24*b*, while temperature devices 26*a*, 26*b* and 26*c* are respectively provided in the lines 12*a*, 12*b* and 12*c*, also between the pumps and the headbox.

The output signals from the flowmeters 20*a*, 20*b* and 20*c* are transmitted to a control unit 30 along lines indicated collectively by M. It will be understood that the lines designated M leading from the flowmeters are the same as the lines M leading to the control unit 30, the intermediate portions of these lines being omitted for clarity of illustration; lines M correspond to line 31 of FIG. 1.

Signals representative of the specific gravity of the two foamed furnishes in the system of FIG. 2 are respectively transmitted by the devices 22*ac* and 22*b* to the control unit 30 along lines collectively designated D, corresponding to line 32 of FIG. 1; devices 24*ac* and 24*b* respectively transmit signals representative of the pressure of the two foamed furnishes to the control unit 30 along lines collectively designated P, corresponding to line 33 of FIG. 1; and devices 26*a*, 26*b* and 26*c* transmit signals representative of the furnish flow temperature to the unit 30 along lines collectively designated T corresponding to line 34 of FIG. 1. In addition, a linear voltage differential transformer device 36 for measuring the variable height of the headbox slice opening transmits a signal representative of the measured height to the control unit 30 along line 37. Input of other values (including reference temperature and reference pressure values) to the control unit 30 is indicated at 38, also as in FIG. 1.

The control unit 30, like that of FIG. 1, is a device for receiving and combining the signals from the various sensing or measuring instrumentalities just mentioned, with each other and with the other values, to determine values of corrected instantaneous volume flow rate $F_a$, $F_b$, and $F_c$ in the three lines 12*a*, 12*b* and 12*c*, respectively, in accordance with the relations $$F(a)=M_aD_{ac}+M_a(1-D_{ac})T_{1a}P_{ac}/T_aP_{1ac} \quad (6)$$

$$F(b)=M_bD_b+M_b(1-D_b)T_{1b}P_b/T_bP_{1b} \quad (7)$$

$$F(c)=M_cD_{ac}+M_c(1-D_{ac})T_{1c}P_{ac}/T_cP_{1ac} \quad (8)$$

wherein the various letters have the same significance as in relation (2) above, and the lower case subscripts indicate the sources of measured values or the lines or furnish flows to which they pertain; thus, for example, $D_{ac}$ is the specific gravity of the furnish in line 12*ac* as measured by device 22*ac*, and $T_{1a}$ is the reference temperature value for the furnish in line 12*a*.

The control unit 30 generates control signals, and transmits them to pumps 14*ac* and 14*b* along lines 40*ac* and 40*b* respectively, in response to departure of F values determined in accordance with relations (6), (7), and/or (8) from correspondingly desired $F_o$ values, to modify the operation of one or both pumps so as to change the F value of one or more of the flows toward the corresponding $F_o$ value, which is derived by unit 30 from other values included in input 38.

By way of specific example, if it is desired to maintain a desired value $R_o$ of the ratio R between adjacent individual furnish flows in the headbox channels 110*a* and 110*b*, the value $R_o$ is included in input 38, and the control unit determines $$R=F(a)/F(b) \quad (9)$$

and transmits appropriate control signals to one or both pumps, in response to departure of R from $R_o$, for varying the speed of the pump or pumps so as to alter F(a) and/or F(b) in a way to change R toward $R_o$. Again, to maintain a desired overall jet velocity $V_o$(TOT), the control unit 30 adds the three instantaneous values F(a), F(b) and F(c) to obtain a total corrected instantaneous flow rate F(TOT), i.e. in accordance with the relation $$F(TOT)=F(a)+F(b)+F(c) \quad (10)$$

and, by further combining F(TOT) with H (from device 36) and W (from input 38), determines the instantaneous combined jet velocity $$V(TOT)=F(TOT)/WH \quad (11).$$

Then, in response to departure of V(TOT) from $V_o$(TOT), the control unit 30 transmits signals to one or both pumps for changing the instantaneous F value of the least one of the flows so as to alter F(TOT) toward a value of $F_o$(TOT) such that $$F_o(TOT)=V(TOT)\cdot WH \quad (12).$$

As in the case of the FIG. 1 embodiment, practice of the method of the invention with the system and apparatus of FIG. 2 involves continuously advancing furnish flows along lines 12*a*, 12*b* and 12*c* and out through the headbox slice opening into nip 119 by the action of pumps 14*ac* and 14*b* while continuously advancing wires 115 and 117 and while continuously or repetitively determining the values of M, D, T and P for each furnish flow, transmitting signals representing these values to the control unit 30, continuously or repetitively combining them with each other and with other values including $P_1$ and $T_1$ in the control unit in accordance with relations (6), (7) and (8) to determine instantaneous corrected volume flow rate values F(a), F(b) and F(c), and generating and transmitting control signals to one or both pumps in response to departure of one or more of these F values from a desired corresponding value $F_o$ to vary the operation of the pump or pumps so as to change the F value or values toward the desired $F_o$ value or values, the F and $F_o$ values being utilized either directly or as functions of other values, e.g. R and $R_o$ values or V(TOT) and $V_o$(TOT) values.

The FIG. 2 system is illustrative of multichannel headbox systems in which the method and apparatus of the invention are utilized to control plural flows of foamed furnishes. Appropriate adaptations of the arrangements shown to different pluralities of flows will be readily apparent from this example.

By way of specific illustration, following are commercially available instruments suitable for use in a control system embodying the invention:

pressure transmitter 24—Rosemount Alphaline model 1151 GP gauge pressure transmitter;

flow meter 20—Fisher & Porter Mag X magnetic flow meter;

temperature transmitter 26—Foxboro Company 44B temperature transmitter;

density transmitter 22—Automation Products, Inc., Dynatrol CL density transmitter;

controller 30—Texas Instruments PM 550 programmable controller;

pump 14—Warren Pumps, Inc., 2500 Series screw pump with variable speed drive;

linear voltage differential transformer 36—Robinson Halpern Co., LVDT linear transmitter.

It is to be understood that the invention is not limited to the procedures and embodiments hereinabove specifically set forth, but may be carried out in other ways without departure from its spirit.

We claim:

1. A method of continuously discharging a flow of foamed gas-liquid-fiber slurry through a headbox slice opening onto a continuously moving foraminous support to establish thereon a continuous web of fibers, while controlling the flow of the slurry through the headbox, comprising:

(a) controllably advancing a flow of the foamed gas-liquid-fiber slurry along a defined path into the headbox for impelling the slurry through the slice opening onto the foraminous support, while (b) with a magnetic flowmeter, sensing, and producing a first signal representative of, the volume flow rate M of the slurry at a given point in the path, and while (c) sensing, and producing a second signal representative of, the density D of the slurry in the path, and while (d) sensing, and producing a third signal representative of, the pressure P of the slurry in the path, and while (e) combining the first, second, and third signals with each other and with values representative of a reference pressure $P_1$ to determine the value F of a flow condition of the slurry, in accordance with the relation $$F=MD+M(1-D)(T_1/T)(P/P_1)$$

wherein $T_1$ is a reference temperature and T is the temperature of the slurry, (f) when T differs from $T_1$ sensing, and producing a fourth signal representative of, the temperature T of the slurry in the path, wherein in this case the combining step further includes combining the fourth signal with a value representative of the reference temperature $T_1$ to determine the value of $T_1/T$, and (g) controlling the advance of the slurry flow along the path, in response to departure of F from a desired value $F_o$, for changing the value of F toward $F_o$.

2. A method according to claim 1, wherein said headbox slice opening is generally rectangular and has a fixed width W and a variable height H; further including the step of sensing, and producing a fifth signal representative of, the slice opening height H; wherein the combining step further comprises combining the determined value of F with the fifth signal and with a value representative of the slice opening width W to determine the value V of the velocity of the slurry as discharged through the slice opening, in accordance with the relation $$V=F/WH;$$

and wherein the controlling step comprises controlling the advance of the slurry flow along the path, in response to departure of V from a desired value $V_o$, for changing the value of F toward $F_o$ such that $$F_o=V_oWH.$$

3. A method according to claim 1, wherein the value of $T_1/T$ is unity.

4. A method according to claim 1, wherein plural flows of gas-liquid-fiber slurry are discharged in substantially parallel relation to each other through said headbox slice opening onto said foraminous support to establish thereon a continuous web of the fibers having plural strata respectively corresponding to said plural flows; wherein the advancing step comprises controllably advancing said plural flows along respective defined paths into the headbox; and wherein steps (b), (c), (d), and (e) are performed for each of said plural flows, to determine for each of said plural flows a value F.

5. A method according to claim 4, wherein there are at least two flows of slurry discharged as aforesaid, the ratio of their respective flow conditions being given by $$R=F(a)/F(b)$$

where F(a) is the value F of one of said two flows, and F(b) is the value F of the other of said two flows; and wherein the controlling step comprises controlling the advance of at least said one flow along its path, in response to departure of R from a desired value $R_o$, for changing the value of R toward $R_o$.

6. A method according to claim 4, wherein the combining step further comprises adding together the values of F respectively determined for said plural flows to obtain a total value F(TOT); and wherein the controlling step comprises controlling the advance of at least one of said plural flows along its respective path, in response to departure of F(TOT) from a desired value $F_o$(TOT), for changing the value of F(TOT) toward $F_o$(TOT).

7. A method according to claim 6, wherein said headbox slice opening is generally rectangular and has a fixed width W and a variable height H; further including the step of sensing, and producing an additional signal representative of, the slice opening height; wherein the combining step further comprises combining the determined value of F(TOT) with the additional signal and with a value representative of the slice opening width W to determine the value V(TOT) of the velocity of the combined flows of slurry as discharged through the slice opening, in accordance with the relation $$V(TOT)=F(TOT)/WH;$$

and wherein the controlling step comprises controlling the advance of at least one of the slurry flows along its respective path, in response to departure of V(TOT) from a desired value $V_o$(TOT), for changing the value of V(TOT) toward $V_o$(TOT).

8. A method according to claim 1, wherein the advancing step comprises operating a pump, having an output characteristic that is variable in response to a control signal, for advancing the slurry flow as aforesaid; and wherein the controlling step comprises generating, and transmitting to the pump, a control signal in response to departure of F from a desired value $F_o$ aforesaid.

* * * * *